US010181377B2

(12) United States Patent
Nagasaki et al.

(10) Patent No.: US 10,181,377 B2
(45) **Date of Patent: *Jan. 15, 2019**

(54) PRODUCTION METHOD FOR RARE EARTH PERMANENT MAGNET

(71) Applicant: Shin-Etsu Chemical Co., Ltd., Tokyo (JP)

(72) Inventors: Yoshifumi Nagasaki, Echizen (JP); Masanobu Shimao, Echizen (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 282 days.

This patent is subject to a terminal disclaimer.

(21) Appl. No.: 14/424,735

(22) PCT Filed: Aug. 30, 2013

(86) PCT No.: PCT/JP2013/073327
§ 371 (c)(1),
(2) Date: Feb. 27, 2015

(87) PCT Pub. No.: WO2014/034851
PCT Pub. Date: Mar. 6, 2014

(65) Prior Publication Data

US 2015/0206653 A1 Jul. 23, 2015

(30) Foreign Application Priority Data

Aug. 31, 2012 (JP) ..... 2012-191584

(51) Int. Cl.
*H01F 41/02* (2006.01)
*C21D 1/18* (2006.01)
(Continued)

(52) U.S. Cl.
CPC ..... *H01F 41/0253* (2013.01); *B22F 3/24* (2013.01); *C21D 1/18* (2013.01); *C22C 38/002* (2013.01);
(Continued)

(58) Field of Classification Search
None
See application file for complete search history.

(56) References Cited

U.S. PATENT DOCUMENTS 4,210,507 A 7/1980 Davidson et al.
4,280,881 A 7/1981 Montagna et al.
(Continued)

FOREIGN PATENT DOCUMENTS

CN 1898757 A 1/2007
CN 102103916 A 6/2011
(Continued)

OTHER PUBLICATIONS

Soderžnik et al. (Intermetallics; 2012, vol. 23, p. 158-162; available online Dec. 27, 2011).*
(Continued)

*Primary Examiner* — Xiaowei Su
(74) *Attorney, Agent, or Firm* — Westerman, Hattori, Daniels & Adrian, LLP

(57) ABSTRACT

A production method for a rare earth permanent magnet, wherein: a sintered magnet body comprising an $R^1$—Fe—B composition ($R^1$ represents one or more elements selected from among rare earth elements, including Y and Sc) is immersed in an electrodeposition liquid obtained by dispersing a powder containing an $R^2$ oxyfluoride and/or an $R^3$ hydride ($R^2$ and $R^3$ represent one or more elements selected from among rare earth elements, including Y and Sc) in a solvent; an electrodeposition process is used to coat the powder onto the surface of the sintered magnet body; and,
(Continued)

in the state in which the powder is present on the surface of the magnet body, the magnet body and the powder are subjected to a heat treatment in a vacuum or an inert gas at a temperature equal to or less than the sintering temperature of the magnet.

19 Claims, 1 Drawing Sheet

(51) Int. Cl.

| | |
|---|---|
| ***C25D 15/00*** | (2006.01) |
| ***C25D 5/48*** | (2006.01) |
| ***B22F 3/24*** | (2006.01) |
| ***C22C 38/00*** | (2006.01) |
| ***C22C 38/02*** | (2006.01) |
| ***C22C 38/06*** | (2006.01) |
| ***C22C 38/14*** | (2006.01) |
| ***C25D 13/02*** | (2006.01) |
| ***C25D 13/22*** | (2006.01) |
| ***C25D 5/34*** | (2006.01) |
| ***C25D 7/00*** | (2006.01) |
| ***H01F 41/00*** | (2006.01) |
| *H01F 1/057* | (2006.01) |

(52) U.S. Cl.

CPC ..... *C22C 38/005* (2013.01); *C22C 38/02* (2013.01); *C22C 38/06* (2013.01); *C22C 38/14* (2013.01); *C25D 5/34* (2013.01); *C25D 5/48* (2013.01); *C25D 7/001* (2013.01); *C25D 13/02* (2013.01); *C25D 13/22* (2013.01); *C25D 15/00* (2013.01); *H01F 41/005* (2013.01); *H01F 41/0293* (2013.01); *B22F 2003/242* (2013.01); *B22F 2003/248* (2013.01); *H01F 1/0577* (2013.01)

(56) References Cited

U.S. PATENT DOCUMENTS

| | | | | |
|---|---|---|---|---|
| 4,959,273 | A | 9/1990 | Hamamura et al. | |
| 5,034,146 | A | 7/1991 | Ohashi et al. | |
| 6,261,426 | B1 | 7/2001 | Uzoh et al. | |
| 7,559,996 | B2 | 7/2009 | Miyata et al. | |
| 2003/0127337 | A1 | 7/2003 | Hanson et al. | |
| 2006/0000704 | A1 | 1/2006 | Sato et al. | |
| 2006/0108226 | A1 | 5/2006 | Wolz | |
| 2007/0017601 | A1 | 1/2007 | Miyata et al. | |
| 2007/0175759 | A1 | 8/2007 | Klocke et al. | |
| 2008/0035475 | A1 | 2/2008 | Gephart et al. | |
| 2008/0245442 | A1 | 10/2008 | Nakamura et al. | |
| 2009/0098006 | A1* | 4/2009 | Nakamura | B22F 7/02 419/9 |
| 2009/0134034 | A1 | 5/2009 | Pass | |
| 2009/0297699 | A1 | 12/2009 | Baba et al. | |
| 2011/0150691 | A1 | 6/2011 | Nakamura et al. | |
| 2011/0168558 | A1* | 7/2011 | Fransaer | C09D 5/024 204/477 |
| 2012/0139388 | A1 | 6/2012 | Iwasaki et al. | |
| 2013/0092867 | A1 | 4/2013 | Shoji et al. | |
| 2015/0211138 | A1* | 7/2015 | Nagasaki | C22C 38/002 148/102 |
| 2015/0211139 | A1* | 7/2015 | Nagasaki | C22C 38/002 148/102 |
| 2015/0233006 | A1* | 8/2015 | Kuribayashi | C25D 7/001 205/119 |
| 2015/0233007 | A1* | 8/2015 | Kuribayashi | C25D 7/001 205/122 |

FOREIGN PATENT DOCUMENTS

| | | | |
|---|---|---|---|
| CN | 102693828 | A | 9/2012 |
| EP | 2 892 064 | A1 | 7/2015 |
| EP | 2 894 645 | A1 | 7/2015 |
| JP | 02-083905 | A | 3/1990 |
| JP | 05-021218 | A | 1/1993 |
| JP | 05-031807 | B2 | 5/1993 |
| JP | H10-311913 | A | 11/1998 |
| JP | 2000-58731 | A | 2/2000 |
| JP | 2005-29864 | A | 2/2005 |
| JP | 2006-517004 | A | 7/2006 |
| JP | 2006303434 | A | 11/2006 |
| JP | 2007-053351 | A | 3/2007 |
| JP | 2007-53351 | A | 3/2007 |
| JP | 2007-288020 | A | 11/2007 |
| JP | 2007-288021 | A | 11/2007 |
| JP | 2007-305818 | A | 11/2007 |
| JP | 2007-313403 | A | 12/2007 |
| JP | 2008-061333 | A | 3/2008 |
| JP | 2009-165349 | A | 7/2009 |
| JP | 2010-135529 | A | 6/2010 |
| JP | 2011-051851 | A | 3/2011 |
| JP | 2011-114149 | A | 6/2011 |
| JP | 2011-219844 | A | 11/2011 |
| JP | 2012-169436 | A | 9/2012 |
| JP | 2012-522126 | A | 9/2012 |
| JP | 2013-106494 | A | 5/2013 |
| KR | 10-2012-0006518 | A | 1/2012 |
| WO | 2004/020704 | A1 | 3/2004 |
| WO | 2006/043348 | A1 | 4/2006 |
| WO | 2011/108704 | A1 | 9/2011 |

OTHER PUBLICATIONS

International Search Report dated Oct. 8, 2013, issued in corresponding application No. PCT/JP2013/073327.

Durst, et al., "The Coercive Field of Sintered and Melt-Spun NdFeB Magnets", Journal of Magnetism and Magnetic Materials, 1987, vol. 68, pp. 63-75, cited in Specification.

Park et al., "Effect of Metal-Coating and Consecutive Heat Treatment on Coercivity of Thin Nd—Fe—B Sintered Magnets", Proceedings of the Sixteenth International Workshop on Rare-Earth Magnets and Their Applications, 2000, pp. 257-264, cited in Specification.

Machida, et al., "Grain Boundary Modification and Magnetic Properties of Nd—Fe—B Sintered Magnets", Abstracts of Spring Meeting of Japan Society of Powder and Powder Metallurgy, 2004, pp. 202, cited in Specification, w/English translation, (3 pages).

Extended (Supplementary) European Search Report dated May 4, 2016, issued in counterpart European Patent Application No. 13 83 2562. (6 pages).

Partial European Search Report dated Aug. 3, 2015, issued in counterpart European Application No. 15155339.3 (5 pages).

Office Action dated Dec. 20, 2016, issued in counterpart Japanese Application No. 2014-029677. (4 pages).

Suppan et al., "Electroplating dysprosium from IL-Based Solutions: A Promising Electrochemical Step to Produce Stronger High Performance ND(Dy)—Fe—B Sintered Magnets", Journal of the Electrochemical Society, vol. 162, No. 8, Jan. 1, 2015 (7 pages). Cited in EESR dated Aug. 3, 2015.

International Search Report dated Oct. 8, 2013, issued in International Application No. PCT/JP2013/073333. (2 pages).

Office Action dated Jul. 5, 2016, issued in counterpart Japanese Patent Application No. 2013-179444, with English translation. (6 pages).

Nakamura, H., et al., "Coercivity Distributions in Nd—Fe—B Sintered Magnets Produced by the Grain Boundary Diffusion Process", Journal of Physics D: Applied Physics, 2011, 44, 064003, pp. 1-5.

Non-Final Office Action dated Dec. 9, 2015, issued in U.S. Appl. No. 14/624,779 (33 pages).

Non-Final Office Action dated Dec. 21, 2016, issued in U.S. Appl. No. 14/624,779 (26 pages).

International Search Report dated Oct. 8, 2013, issued in counterpart International Application No. PCT/JP2013/073324 (2 pages).

Office Action dated May 11, 2016, issued in counterpart Chinese Patent Application No. 201380044779.0, with English translation. (16 pages).

(56) References Cited

OTHER PUBLICATIONS

Office Action dated Jun. 7, 2016, issued in counterpart Japanese Patent Application No. 2013-179407, with English translation. (6 pages).
Extended (supplementary) European Search Report dated Mar. 22, 2016, issued in counterpart European Patent Application No. 13832170. 8. (10 pages).
Extended European Search Report dated Aug. 3, 2015, issued in counterpart Application No. 15155176.9. (7 pages).
Final Office Action dated Apr. 13, 2017, issued in U.S. Appl. No. 14/624,779 (14 pages).
Non-Final Office Action dated Mar. 9, 2017, issued in U.S. Appl. No. 14/424,647 (33 pages).
Extended (supplementary) European Search Report dated Mar. 22, 2016, issued in counterpart European Patent Application No. 13832698. 8. (9 pages).
Non-Final Office Action dated Mar. 10, 2017, issued in U.S. Appl. No. 14/424,707 (37 pages).
Non-Final Office Action dated Feb. 18, 2016, issued in U.S. Appl. No. 14/625,277 (26 pages).
Final Office Action dated Oct. 7, 2016, issued in U.S. Appl. No. 14/625,277 (20 pages).
Novak, et al., "Fabrication of alumina parts by electrophoretic deposition from ethanol and aqueous suspensions", Ceramics International, 35, 2009, pp. 2823-2829.
Chinese Office Action dated Jun. 27, 2017, issued in counterpart Chinese Patent Application No. 201510085234.5 with English translation.
Final Office Action dated Jun 17, 2016, issued in U.S. Appl. No. 14/624,779 (22 pages).
International Search Report dated Oct. 8, 2013, issued in counterpart International Application No. PCT/JP2013/073327. (4 pages).
Final Office Action dated Aug. 11, 2017, issued in U.S. Appl. No. 14/424,707 (17 pages).
Q. Li et al., "Electroplating of anticorrosive Ni—Ti02 composite coatings on sintered NdFeB permanent magnets", Transactions of the Institute of Metal Finishing, Maney Publishing, Birmingham, GB, vol. 87, No. 3, May 1, 2009, pp. 149-154.

* cited by examiner

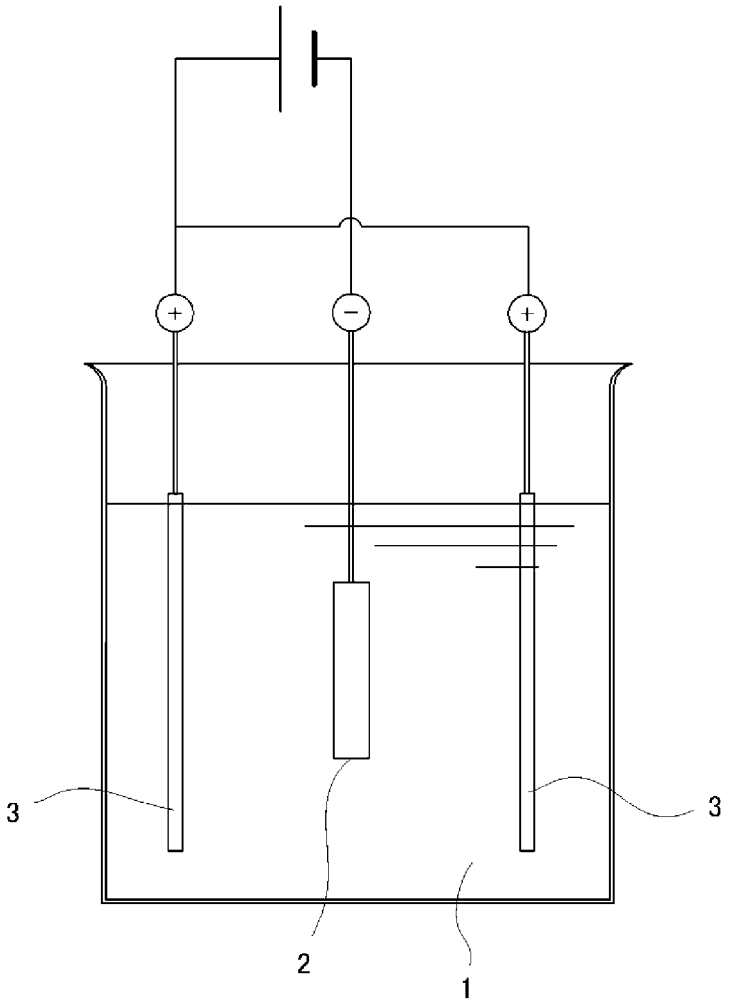
+
−
+
3
3
2
1

PRODUCTION METHOD FOR RARE EARTH PERMANENT MAGNET

TECHNICAL FIELD

This invention relates to a method for preparing a R—Fe—B base permanent magnet which is increased in coercive force while suppressing a decline of remanence (or residual magnetic flux density).

BACKGROUND ART

By virtue of excellent magnetic properties, Nd—Fe—B base permanent magnets find an ever increasing range of application. In the field of rotary machines such as motors and power generators, permanent magnet rotary machines using Nd—Fe—B base permanent magnets have recently been developed in response to the demands for weight and profile reduction, performance improvement, and energy saving. The permanent magnets within the rotary machine are exposed to elevated temperature due to the heat generation of windings and iron cores and kept susceptible to demagnetization by a diamagnetic field from the windings. There thus exists a need for a sintered Nd—Fe—B base magnet having heat resistance, a certain level of coercive force serving as an index of demagnetization resistance, and a maximum remanence serving as an index of magnitude of magnetic force.

An increase in the remanence of sintered Nd—Fe—B base magnets can be achieved by increasing the volume factor of $Nd_2Fe_{14}B$ compound and improving the crystal orientation. To this end, a number of modifications have been made on the process. For increasing coercive force, there are known different approaches including grain refinement, the use of alloy compositions with greater Nd contents, and the addition of effective elements. The currently most common approach is to use alloy compositions in which Dy or Tb substitutes for part of Nd. Substituting these elements for Nd in the $Nd_2Fe_{14}B$ compound increases both the anisotropic magnetic field and the coercive force of the compound. The substitution with Dy or Tb, on the other hand, reduces the saturation magnetic polarization of the compound. Therefore, as long as the above approach is taken to increase coercive force, a loss of remanence is unavoidable.

In sintered Nd—Fe—B base magnets, the coercive force is given by the magnitude of an external magnetic field created by nuclei of reverse magnetic domains at grain boundaries. Formation of nuclei of reverse magnetic domains is largely dictated by the structure of the grain boundary in such a manner that any disorder of grain structure in proximity to the boundary invites a disturbance of magnetic structure, helping formation of reverse magnetic domains. It is generally believed that a magnetic structure extending from the grain boundary to a depth of about 5 nm contributes to an increase of coercive force (see Non-Patent Document 1). The inventors discovered that when a slight amount of Dy or Tb is concentrated only in proximity to the interface of grains for thereby increasing the anisotropic magnetic field only in proximity to the interface, the coercive force can be increased while suppressing a decline of remanence (Patent Document 1). Further the inventors established a method of producing a magnet comprising separately preparing a $Nd_2Fe_{14}B$ compound composition alloy and a Dy or Tb-rich alloy, mixing and sintering (Patent Document 2). In this method, the Dy or Tb-rich alloy becomes a liquid phase during the sintering step and is distributed so as to surround the $Nd_2Fe_{14}B$ compound. As a result, substitution of Dy or Tb for Nd occurs only in proximity to grain boundaries of the compound, which is effective in increasing coercive force while suppressing a decline of remanence.

The above method, however, suffers from some problems. Since a mixture of two alloy fine powders is sintered at a temperature as high as 1,000 to 1,100° C., Dy or Tb tends to diffuse not only at the interface of $Nd_2Fe_{14}B$ crystal grains, but also into the interior thereof. An observation of the structure of an actually produced magnet reveals that Dy or Tb has diffused in a grain boundary surface layer to a depth of about 1 to 2 microns from the interface, and the diffused region accounts for a volume fraction of 60% or above. As the diffusion distance into crystal grains becomes longer, the concentration of Dy or Tb in proximity to the interface becomes lower. Lowering the sintering temperature is effective to minimize the excessive diffusion into crystal grains, but not practically acceptable because low temperatures retard densification by sintering. An alternative approach of sintering a compact at low temperature under a pressure applied by a hot press or the like is successful in densification, but entails an extreme drop of productivity.

Another method for increasing coercive force is known in the art which method comprises machining a sintered magnet into a small size, applying Dy or Tb to the magnet surface by sputtering, and heat treating the magnet at a lower temperature than the sintering temperature for causing Dy or Tb to diffuse only at grain boundaries (see Non-Patent Documents 2 and 3). Since Dy or Tb is more effectively concentrated at grain boundaries, this method succeeds in increasing the coercive force without substantial sacrifice of remanence. This method is applicable to only magnets of small size or thin gage for the reason that as the magnet has a larger specific surface area, that is, as the magnet is smaller in size, a larger amount of Dy or Tb is available. However, the application of metal coating by sputtering poses the problem of low productivity.

One solution to these problems is proposed in Patent Documents 3 and 4. A sintered magnet body of $R^1$—Fe—B base composition wherein $R^1$ is at least one element selected from rare earth elements inclusive of Y and Sc is coated on its surface with a powder containing an oxide, fluoride or oxyfluoride of $R^2$ wherein $R^2$ is at least one element selected from rare earth elements inclusive of Y and Sc. The coated magnet body is heat treated whereby $R^2$ is absorbed in the magnet body.

This method is successful in increasing coercive force while significantly suppressing a decline of remanence. Still some problems must be overcome before the method can be implemented in practice. Means of providing a powder on the surface of a sintered magnet body is by immersing the magnet body in a dispersion of the powder in water or organic solvent, or spraying the dispersion to the magnet body, both followed by drying. The immersion and spraying methods are difficult to control the coating weight (or coverage) of powder. A short coverage fails in sufficient absorption of $R^2$. Inversely, if an extra amount of powder is coated, precious $R^2$ is consumed in vain. Also since such a powder coating largely varies in thickness and is not so high in density, an excessive coverage is necessary in order to enhance the coercive force to the saturation level. Furthermore, since a powder coating is not so adherent, problems are left including poor working efficiency of the process from the coating step to the heat treatment step and difficult treatment over a large surface area.

CITATION LIST

Patent Documents

Patent Document 1: JP-B H05-31807

Patent Document 2: JP-A H05-21218

Patent Document 3: JP-A 2007-053351

Patent Document 4: WO 2006/043348

Non-Patent Documents

Non-Patent Document 1: K. D. Durst and H. Kronmuller, "THE COERCIVE FIELD OF SINTERED AND MELT-SPUN NdFeB MAGNETS," Journal of Magnetism and Magnetic Materials, 68 (1987), 63-75

Non-Patent Document 2: K. T. Park, K. Hiraga and M. Sagawa, "Effect of Metal-Coating and Consecutive Heat Treatment on Coercivity of Thin Nd—Fe—B Sintered Magnets," Proceedings of the Sixteen International Workshop on Rare-Earth Magnets and Their Applications, Sendai, p. 257 (2000)

Non-Patent Document 3: K. Machida, H. Kawasaki, S. Suzuki, M. Ito and T. Horikawa, "Grain Boundary Tailoring of Nd—Fe—B Sintered Magnets and Their Magnetic Properties," Proceedings of the 2004 Spring Meeting of the Powder & Powder Metallurgy Society, p. 202

SUMMARY OF INVENTION

Technical Problem

In conjunction with a method for preparing a rare earth permanent magnet by coating the surface of a sintered magnet body having a $R^1$—Fe—B base composition (wherein $R^1$ is at least one element selected from rare earth elements inclusive of Y and Sc) with a powder containing a $R^2$ oxyfluoride or $R^3$ hydride (wherein $R^2$ and $R^3$ each are at least one element selected from rare earth elements inclusive of Y and Sc) and heat treating the coated magnet body, an object of the invention is to improve the step of coating the magnet body surface with the powder so as to form a uniform dense coating of the powder on the magnet body surface, thereby enabling to prepare a rare earth magnet of high performance having a satisfactory remanence and high coercive force in an efficient manner.

Solution to Problem

In conjunction with a method for preparing a rare earth permanent magnet with an increased coercive force by heating a $R^1$—Fe—B base sintered magnet body, typically Nd—Fe—B base sintered magnet with a particle powder containing an oxyfluoride of $R^2$ and/or a hydride of $R^3$ (wherein $R^2$ and $R^3$ each are at least one element selected from rare earth elements inclusive of Y and Sc) disposed on the magnet body surface, for causing $R^2$ and/or $R^3$ to be absorbed in the magnet body, the inventors have found that better results are obtained by immersing the magnet body in an electrodepositing bath of the powder dispersed in a solvent and effecting electrodeposition for letting particles deposit on the magnet body surface. Namely, the coating weight of particles can be easily controlled. A coating of particles with a minimal variation of thickness, an increased density, mitigated deposition unevenness, and good adhesion can be formed on the magnet body surface. Effective treatment over a large area within a short time is possible. Thus, a rare earth magnet of high performance having a satisfactory remanence and high coercive force can be prepared in a highly efficient manner.

Accordingly, the invention provides following methods for preparing a rare earth permanent magnet.

1. A method for preparing a rare earth permanent magnet, comprising the steps of:
   immersing a sintered magnet body having a $R^1$—Fe—B base composition wherein $R^1$ is at least one element selected from rare earth elements inclusive of Y and Sc, in an electrodepositing bath of a powder dispersed in a solvent, said powder comprising an oxyfluoride of $R^2$ and/or a hydride of $R^3$ wherein $R^2$ and $R^3$ each are at least one element selected from rare earth elements inclusive of Y and Sc,
   effecting electrodeposition for letting the powder deposit on the surface of the magnet body, and
   heat treating the magnet body with the powder deposited on its surface at a temperature equal to or less than the sintering temperature of the magnet body in vacuum or in an inert gas.
2. The method of claim 1 wherein the electrodepositing bath is a slurry of the powder dispersed in water or an organic solvent.
3. The method of claim 1 or 2 wherein the powder comprising an oxyfluoride of $R^2$ and/or a hydride of $R^3$ has an average particle size of up to 100 μm.
4. The method of any one of claims 1 to 3 wherein the powder comprising an oxyfluoride of $R^2$ and/or a hydride of $R^3$ is deposited on the magnet body surface in an area density of at least 10 $\mu g/mm^2$.
5. The method of any one of claims 1 to 4 wherein in the oxyfluoride of $R^2$ and hydride of $R^3$, $R^2$ and $R^3$ each contain at least 10 atom % of Dy and/or Tb.
6. The method of claim 5 wherein in the powder comprising the oxyfluoride of $R^2$ and/or hydride of $R^3$, $R^2$ and $R^3$ each contain at least 10 atom % of Dy and/or Tb, and the total concentration of Nd and Pr in $R^2$ and $R^3$ is lower than the total concentration of Nd and Pr in $R^1$.
7. The method of any one of claims 1 to 6, further comprising aging treatment at a lower temperature after the heat treatment.
8. The method of any one of claims 1 to 7, further comprising cleaning the sintered magnet body with at least one of an alkali, acid and organic solvent, prior to the immersion step.
9. The method of any one of claims 1 to 8, further comprising shot blasting the sintered magnet body to remove a surface layer thereof, prior to the immersion step.
10. The method of any one of claims 1 to 9, further comprising final treatment after the heat treatment, said final treatment being cleaning with at least one of an alkali, acid and organic solvent, grinding, plating or coating.

Advantageous Effects of Invention

The method of the invention ensures that a R—Fe—B base sintered magnet having a high remanence and coercive force is prepared in an efficient manner.

BRIEF DESCRIPTION OF DRAWINGS

FIG. 1 The only FIGURE, FIG. 1 schematically illustrates how particles are deposited during the electrodeposition step in the method of the invention.

DESCRIPTION OF EMBODIMENTS

Briefly stated, the method for preparing a rare earth permanent magnet according to the invention involves feeding a particulate oxyfluoride and/or hydride of rare earth elements $R^2$ and $R^3$ onto the surface of a sintered magnet body having a $R^1$—Fe—B base composition and heat treating the particle-coated magnet body.

The $R^1$—Fe—B base sintered magnet body may be obtained from a mother alloy by a standard procedure including coarse pulverization, fine pulverization, compacting, and sintering.

As used herein, R and $R^1$ each are selected from among rare earth elements inclusive of yttrium (Y) and scandium (Sc). R is mainly used for the magnet obtained while $R^1$ is mainly used for the starting material.

The mother alloy contains $R^1$, iron (Fe), and boron (B). $R^1$ represents one or more elements selected from among rare earth elements inclusive of Y and Sc, examples of which include Y, Sc, La, Ce, Pr, Nd, Sm, Eu, Gd, Tb, Dy, Ho, Er, Yb, and Lu. Preferably $R^1$ is mainly composed of Nd, Pr, and Dy. The rare earth elements inclusive of Y and Sc should preferably account for 10 to 15 atom %, especially 12 to 15 atom % of the entire alloy. More preferably, $R^1$ should contain either one or both of Nd and Pr in an amount of at least 10 atom %, especially at least 50 atom %. Boron (B) should preferably account for 3 to 15 atom %, especially 4 to 8 atom % of the entire alloy. The alloy may further contain 0 to 11 atom %, especially 0.1 to 5 atom % of one or more elements selected from among Al, Cu, Zn, In, Si, P, S, Ti, V, Cr, Mn, Ni, Ga, Ge, Zr, Nb, Mo, Pd, Ag, Cd, Sn, Sb, Hf, Ta, and W. The balance consists of Fe and incidental impurities such as C, N and O. Iron (Fe) should preferably account for at least 50 atom %, especially at least 65 atom % of the entire alloy. It is acceptable that Co substitutes for part of Fe, for example, 0 to 40 atom %, especially 0 to 15 atom % of Fe.

The mother alloy is obtained by melting the starting metals or alloys in vacuum or in an inert gas, preferably Ar atmosphere, and then pouring in a flat mold or book mold, or casting as by strip casting. An alternative method, called two-alloy method, is also applicable wherein an alloy whose composition is approximate to the $R_2Fe_{14}B$ compound, the primary phase of the present alloy and an R-rich alloy serving as a liquid phase aid at the sintering temperature are separately prepared, crushed, weighed and admixed together. It is noted that since the alloy whose composition is approximate to the primary phase composition is likely to leave α—Fe phase depending on the cooling rate during the casting or the alloy composition, it is subjected to homogenizing treatment, if desired for the purpose of increasing the amount of $R_2Fe_{14}B$ compound phase. The homogenization is achievable by heat treatment in vacuum or in an Ar atmosphere at 700 to 1,200° C. for at least 1 hour.

The alloy approximate to the primary phase composition may be prepared by strip casting. For the R-rich alloy serving as a liquid phase aid, not only the casting technique described above, but also the so-called melt quenching and strip casting techniques are applicable.

Furthermore, in the pulverizing step to be described below, at least one compound selected from a carbide, nitride, oxide and hydroxide of $R^1$ or a mixture or composite thereof can be admixed with the alloy powder in an amount of 0.005 to 5% by weight.

The alloy is generally coarsely pulverized to a size of 0.05 to 3 mm, especially 0.05 to 1.5 mm. For the coarse pulverizing step, a Brown mill or hydrogen decrepitation (HD) is used, with the HD being preferred for the alloy as strip cast. The coarse powder is then finely pulverized to a size of 0.2 to 30 μm, especially 0.5 to 20 μm, for example, on a jet mill using high pressure nitrogen. The fine powder is compacted in a magnetic field by a compression molding machine and introduced into a sintering furnace. The sintering is carried out in vacuum or an inert gas atmosphere, typically at 900 to 1,250° C., especially 1,000 to 1,100° C.

The sintered magnet thus obtained contains 60 to 99% by volume, preferably 80 to 98% by volume of the tetragonal $R_2Fe_{14}B$ compound as the primary phase, with the balance being 0.5 to 20% by volume of an R-rich phase, 0 to 10% by volume of a B-rich phase, and at least one of carbides, nitrides, oxides and hydroxides resulting from incidental impurities or additives or a mixture or composite thereof.

The sintered block is then machined into a preselected shape. The dimensions of the shape are not particularly limited. In the invention, the amount of $R^2$ or $R^3$ absorbed into the magnet body from the $R^2$ oxyfluoride and/or $R^3$ hydride-containing powder deposited on the magnet body surface increases as the specific surface area of the magnet body is larger, i.e., the size thereof is smaller. For this reason, the shape includes a maximum side having a dimension of up to 100 mm, preferably up to 50 mm, and more preferably up to 20 mm, and has a dimension of up to 10 mm, preferably up to 5 mm, and more preferably up to 2 mm in the direction of magnetic anisotropy. Most preferably, the dimension in the magnetic anisotropy direction is up to 1 mm. It is noted that the invention allows for effective treatment to take place over a larger area and within a short time since the powder is deposited by the electrodeposition technique (to be described later). Effective treatment is possible even when the block is a large one shaped so as to include a maximum side with a dimension in excess of 100 mm and have a dimension in excess of 10 mm in the magnetic anisotropy direction. With respect to the dimension of the maximum side and the dimension in the magnetic anisotropy direction, no particular lower limit is imposed. Preferably, the dimension of the maximum side is at least 0.1 mm and the dimension in the magnetic anisotropy direction is at least 0.05 mm.

On the surface of a sintered magnet body as machined, a powder containing an oxyfluoride of $R^2$ and/or hydride of $R^3$ is attached by the electrodeposition technique. As defined above, each of $R^2$ and $R^3$ is at least one element selected from rare earth elements inclusive of Y and Sc, and should preferably contain at least 10 atom %, more preferably at least 20 atom %, and even more preferably at least 40 atom % of Dy and/or Tb. In a preferred embodiment, $R^2$ and $R^3$ each contain at least 10 atom % of Dy and/or Tb, and the total concentration of Nd and Pr in $R^2$ and/or $R^3$ is lower than the total concentration of Nd and Pr in $R^1$.

For the reason that a more amount of $R^2$ or $R^3$ is absorbed as the coating weight of the powder on the magnet surface is greater, the coating weight should preferably fall in a sufficient range to achieve the benefits of the invention. The coating weight is represented by an area density which is preferably at least 10 $\mu g/mm^2$, more preferably at least 60 $\mu g/mm^2$.

The particle size of the powder affects the reactivity when the $R^2$ or $R^3$ in the powder is absorbed in the magnet body. Smaller particles offer a larger contact area available for the reaction. In order for the invention to attain its effects, the powder disposed on the magnet should desirably have an average particle size equal to or less than 100 μm. No particular lower limit is imposed on the particle size although a particle size of at least 1 nm is preferred. It is noted that the average particle size is determined as a weight average diameter $D_{50}$ (particle diameter at 50% by weight cumulative, or median diameter) using, for example, a particle size distribution measuring instrument relying on laser diffractometry or the like.

The oxyfluoride of $R^2$ and hydride of $R^3$ used herein are preferably $R^2OF$ and $R^3H_3$, respectively, although they generally refer to oxyfluorides containing $R^2$, oxygen and fluorine, and hydrides containing $R^3$ and hydrogen, for example, $R^2O_mF_n$ and $R^3H_n$ wherein m and n are arbitrary positive numbers, and modified forms in which part of $R^2$ or $R^3$ is substituted or stabilized with another metal element as long as they can achieve the benefits of the invention.

The powder disposed on the magnet body surface contains the oxyfluoride of $R^2$, hydride of $R^3$, or a mixture thereof, and may additionally contain at least one compound selected from among oxides, fluorides, carbides, nitrides, and hydroxides of $R^4$, or a mixture or composite thereof wherein $R^4$ is at least one element selected from rare earth elements inclusive of Y and Sc. Further, the powder may contain fines of boron, boron nitride, silicon, carbon or the like, or an organic compound such as stearic acid in order to promote the dispersion or chemical/physical adsorption of particles. In order for the invention to attain its effect efficiently, the powder should preferably contain at least 10% by weight, more preferably at least 20% by weight (based on the entire powder) of the oxyfluoride of $R^2$, hydride of $R^3$, or a mixture thereof. In particular, it is recommended that the powder contain at least 50% by weight, more preferably at least 70% by weight, and even more preferably at least 90% by weight of the oxyfluoride of $R^2$, hydride of $R^3$, or a mixture thereof.

The invention is characterized in that the means for disposing the powder on the magnet body surface is an electrodeposition technique involving immersing the sintered magnet body in an electrodepositing bath of the powder dispersed in a solvent, and effecting electrodeposition (or electrolytic deposition) for letting the powder (or particles) deposit on the magnet body surface. The solvent in which the powder is dispersed may be either water or an organic solvent. Although the organic solvent is not particularly limited, ethanol is most preferred.

The concentration of the powder in the electrodepositing bath is not particularly limited. A slurry containing the powder in a weight fraction of at least 1%, more preferably at least 10%, and even more preferably at least 20% is preferred for effective deposition. Since too high a concentration is inconvenient in that the resultant dispersion is no longer uniform, the slurry should preferably contain the powder in a weight fraction of up to 70%, more preferably up to 60%, and even more preferably up to 50%.

The step of depositing the powder on the magnet body surface via electrodeposition may be performed by the standard technique. For example, as shown in FIG. 1, a tank is filled with an electrodepositing bath 1 having the powder dispersed therein. A sintered magnet body 2 is immersed in the bath 1, and one or more counter electrodes 3 are placed in the tank. A power source is connected to the magnet body 2 and the counter electrodes 3 to construct a DC electric circuit, with the magnet body 2 made a cathode or anode and the counter electrodes 3 made an anode or cathode. With this setup, electrodeposition takes place when a predetermined DC voltage is applied. In FIG. 1, the magnet body 2 is made a cathode and the counter electrode 3 made an anode. Since the polarity of electrodepositing particles changes with a particular surfactant, the polarity of the magnet body 2 and the counter electrode 3 may be accordingly set.

The material of which the counter electrode is made may be selected from well-known materials. Typically a stainless steel plate is used. Also electric conduction conditions may be determined as appropriate. Typically, a voltage of 1 to 300 volts, especially 5 to 50 volts is applied between the magnet body 2 and the counter electrode 3 for 1 to 300 seconds, especially 5 to 60 seconds. Also the temperature of the electrodepositing bath is not particularly limited. Typically the bath is set at 10 to 40° C.

After the powder comprising the oxyfluoride of $R^2$, hydride of $R^3$, or a mixture thereof is disposed on the magnet body surface via electrodeposition as described above, the magnet body and the powder are heat treated in vacuum or in an atmosphere of an inert gas such as argon (Ar) or helium (He). This heat treatment is referred to as "absorption treatment." The absorption treatment temperature is equal to or below the sintering temperature of the sintered magnet body.

If heat treatment is effected above the sintering temperature (designated Ts in ° C.), there arise problems that (1) the structure of the sintered magnet can be altered to degrade magnetic properties, (2) the machined dimensions cannot be maintained due to thermal deformation, and (3) R can diffuse not only at grain boundaries, but also into the interior of the magnet body, detracting from remanence. For this reason, the temperature of heat treatment is equal to or below the sintering temperature of the sintered magnet body, and preferably equal to or below (Ts−10)° C. The lower limit of temperature may be selected as appropriate though it is typically at least 350° C. The time of absorption treatment is typically from 1 minute to 100 hours. Within less than 1 minute, the absorption treatment may not be complete. If the time exceeds 100 hours, the structure of the sintered magnet can be altered and oxidation or evaporation of components inevitably occurs to degrade magnetic properties. The preferred time of absorption treatment is from 5 minutes to 8 hours, and more preferably from 10 minutes to 6 hours.

Through the absorption treatment, $R^2$ and/or $R^3$ contained in the powder deposited on the magnet surface is concentrated in the rare earth-rich grain boundary component within the magnet so that $R^2$ or $R^3$ is incorporated in a substituted manner near a surface layer of $R_2Fe_{14}B$ primary phase grains. Where the powder contains the oxyfluoride of $R^2$, part of the fluorine in the powder is absorbed in the magnet along with $R^2$ to promote a supply of $R^2$ from the powder and the diffusion thereof along grain boundaries in the magnet.

The rare earth element contained in the oxyfluoride of $R^2$ or hydride of $R^3$ is one or more elements selected from rare earth elements inclusive of Y and Sc. Since the elements which are particularly effective for enhancing magnetocrystalline anisotropy when concentrated in a surface layer are Dy and Tb, it is preferred that a total of Dy and Tb account for at least 10 atom % and more preferably at least 20 atom % of the rare earth elements in the powder. Also preferably, the total concentration of Nd and Pr in $R^2$ and $R^3$ is lower than the total concentration of Nd and Pr in $R^1$.

The absorption treatment effectively increases the coercive force of the R—Fe—B sintered magnet without substantial sacrifice of remanence.

According to the invention, the absorption treatment may be carried out by effecting electrodeposition on the sintered magnet body in a slurry of $R^2$ oxyfluoride-containing and/or $R^3$ hydride-containing powder, for letting the powder deposit on the magnet body surface, and heat treating the magnet body having the powder deposited on its surface. Since a plurality of magnet bodies each covered with the powder are spaced apart from each other during the absorption treatment, it is avoided that the magnet bodies are fused together after the absorption treatment which is a heat treatment at a high temperature. In addition, the powder is not fused to the magnet bodies after the absorption treatment. It is then possible to place a multiplicity of magnet bodies in a heat treating container where they are treated simultaneously. The preparing method of the invention is highly productive.

Since the powder is deposited on the magnet body surface via electrodeposition according to the invention, the coating weight of the powder on the surface can be readily controlled by adjusting the applied voltage and time. This ensures that a necessary amount of the powder is fed to the magnet body surface without waste. It is also ensured that a coating of the powder having minimal variation of thickness, an increased density, and mitigated deposition unevenness forms on the magnet body surface. Thus absorption treatment can be carried out with a minimum necessary amount of the powder until the increase of coercive force reaches saturation. In addition to the advantages of efficiency and economy, the electrodeposition step is successful in forming a coating of the powder on the magnet body, even having a large area, in a short time. Further, the coating of powder formed by electrodeposition is more tightly bonded to the magnet body than those coatings of powder formed by immersion and spray coating, ensuring to carry out ensuing absorption treatment in an effective manner. The overall process is thus highly efficient.

The absorption treatment is preferably followed by aging treatment although the aging treatment is not essential. The aging treatment is desirably at a temperature which is below the absorption treatment temperature, preferably from 200° C. to a temperature lower than the absorption treatment temperature by 10° C., more preferably from 350° C. to a temperature lower than the absorption treatment temperature by 10° C. The atmosphere is preferably vacuum or an inert gas such as Ar or He. The time of aging treatment is preferably from 1 minute to 10 hours, more preferably from 10 minutes to 5 hours, and even more preferably from 30 minutes to 2 hours.

Notably, when a sintered magnet block is machined prior to the coverage thereof with the powder by electrodeposition, the machining tool may use an aqueous cooling fluid or the machined surface may be exposed to a high temperature. If so, there is a likelihood that the machined surface (or a surface layer of the sintered magnet body) is oxidized to form an oxide layer thereon. This oxide layer sometimes inhibits the absorption reaction of $R^2$ or $R^3$ from the powder into the magnet body. In such a case, the magnet body as machined is cleaned with at least one agent selected from alkalis, acids and organic solvents or shot blasted for removing the oxide layer. Then the magnet body is ready for absorption treatment.

Suitable alkalis which can be used herein include potassium pyrophosphate, sodium pyrophosphate, potassium citrate, sodium citrate, potassium acetate, sodium acetate, potassium oxalate, sodium oxalate, etc. Suitable acids include hydrochloric acid, nitric acid, sulfuric acid, acetic acid, citric acid, tartaric acid, etc. Suitable organic solvents include acetone, methanol, ethanol, isopropyl alcohol, etc. In the cleaning step, the alkali or acid may be used as an aqueous solution with a suitable concentration not attacking the magnet body. Alternatively, the oxide surface layer may be removed from the sintered magnet body by shot blasting before the powder is deposited thereon.

Also, after the absorption treatment or after the subsequent aging treatment, the magnet body may be cleaned with at least one agent selected from alkalis, acids and organic solvents, or machined again into a practical shape. Alternatively, plating or paint coating may be carried out after the absorption treatment, after the aging treatment, after the cleaning step, or after the last machining step.

EXAMPLES

Examples are given below for further illustrating the invention although the invention is not limited thereto. In Examples, the area density of terbium oxyfluoride or terbium hydride deposited on the magnet body surface is computed from a weight gain of the magnet body after powder deposition and the surface area.

Example 1

An alloy in thin plate form was prepared by a strip casting technique, specifically by weighing Nd, Al, Fe and Cu metals having a purity of at least 99% by weight, Si having a purity of 99.99% by weight, and ferroboron, high-frequency heating in an argon atmosphere for melting, and casting the alloy melt on a copper single roll. The alloy consisted of 14.5 atom % of Nd, 0.2 atom % of Cu, 6.2 atom % of B, 1.0 atom % of Al, 1.0 atom % of Si, and the balance of Fe. Hydrogen decrepitation was carried out by exposing the alloy to 0.11 MPa of hydrogen at room temperature to occlude hydrogen and then heating at 500° C. for partial dehydriding while evacuating to vacuum. The decrepitated alloy was cooled and sieved, yielding a coarse powder under 50 mesh.

Subsequently, the coarse powder was finely pulverized on a jet mill using high-pressure nitrogen gas into a fine powder having a mass median particle diameter of 5 μm. The fine powder was compacted in a nitrogen atmosphere under a pressure of about 1 ton/cm$^2$ while being oriented in a magnetic field of 15 kOe. The green compact was then placed in a sintering furnace with an argon atmosphere where it was sintered at 1,060° C. for 2 hours, obtaining a sintered magnet block. Using a diamond cutter, the magnet block was machined on all the surfaces into a magnet body having dimensions of 17 mm×17 mm×2 mm (magnetic anisotropy direction). It was cleaned in sequence with alkaline solution, deionized water, nitric acid and deionized water, and dried.

Subsequently, terbium oxyfluoride (TbOF) having an average particle size of 0.2 μm was thoroughly mixed with water at a weight fraction of 40% to form a slurry having terbium oxyfluoride particles dispersed therein. The slurry served as an electrodepositing bath.

With the setup shown in FIG. 1, the magnet body 2 was immersed in the slurry 1. A pair of stainless steel plates (SUS304) were immersed as counter electrodes 3 while they were spaced 20 mm apart from the magnet body 2. A power supply was connected to construct an electric circuit, with the magnet body 2 made a cathode and the counter electrodes 3 made anodes. A DC voltage of 10 volts was applied for 10 seconds to effect electrodeposition. The magnet body was pulled out of the slurry and immediately dried in hot air. It was found that a thin coating of terbium oxyfluoride had deposited on the magnet body surface. The area density of terbium oxyfluoride deposited was 100 μg/mm$^2$ on the magnet body surface.

The magnet body having a thin coating of terbium oxyfluoride particles tightly deposited thereon was subjected to absorption treatment in an argon atmosphere at 900° C. for 5 hours. It was then subjected to aging treatment at 500° C. for one hour, and quenched, obtaining a magnet body. The absorption treatment increased the coercive force by 720 kA/m.

Example 2

As in Example 1, a magnet body having dimensions of 17 mm×17 mm×2 mm (magnetic anisotropy direction) was prepared. Also, terbium oxyfluoride (TbOF) having an average particle size of 0.2 μm was thoroughly mixed with ethanol at a weight fraction of 40% to form a slurry having terbium oxyfluoride particles dispersed therein. The slurry served as an electrodepositing bath.

As in Example 1, the magnet body and the counter electrodes were immersed in the slurry. A power supply was connected to construct an electric circuit, with the magnet body made a cathode and the counter electrodes made anodes. A DC voltage of 10 volts was applied for 10 seconds to effect electrodeposition. The magnet body was pulled out of the slurry and immediately dried in hot air. It was found that a thin coating of terbium oxyfluoride had deposited on the magnet body surface. The area density of terbium oxyfluoride deposited was 100 μg/mm$^2$ on the magnet body surface.

The magnet body having a thin coating of terbium oxyfluoride particles deposited thereon was subjected to absorption treatment in an argon atmosphere at 900° C. for 5 hours. It was then subjected to aging treatment at 500° C. for one hour, and quenched, obtaining a magnet body. The absorption treatment increased the coercive force by 720 kA/m.

Example 3

As in Example 1, a magnet body having dimensions of 17 mm×17 mm×2 mm (magnetic anisotropy direction) was prepared. Also, terbium hydride ($TbH_2$) having an average particle size of 0.2 μm was mixed with water at a weight fraction of 40% to form a slurry having terbium hydride particles dispersed therein. The slurry served as an electrodepositing bath.

As in Example 1, the magnet body and the counter electrodes were immersed in the slurry. A power supply was connected to construct an electric circuit, with the magnet body made a cathode and the counter electrodes made anodes. A DC voltage of 10 volts was applied for 10 seconds to effect electrodeposition. The magnet body was pulled out of the slurry and immediately dried in hot air. It was found that a thin coating of terbium hydride had deposited on the magnet body surface. The area density of terbium hydride deposited was 100 μg/mm$^2$ on the magnet body surface.

The magnet body having a thin coating of terbium hydride particles deposited thereon was subjected to absorption treatment in an argon atmosphere at 900° C. for 5 hours. It was then subjected to aging treatment at 500° C. for one hour, and quenched, obtaining a magnet body. The absorption treatment increased the coercive force by 720 kA/m.

Example 4

As in Example 1, a magnet body having dimensions of 17 mm×17 mm×2 mm (magnetic anisotropy direction) was prepared. Also, terbium hydride ($TbH_2$) having an average particle size of 0.2 μm was thoroughly mixed with ethanol at a weight fraction of 40%, forming a slurry having terbium hydride particles dispersed therein. The slurry served as an electrodepositing bath.

As in Example 1, the magnet body and the counter electrodes were immersed in the slurry. A power supply was connected to construct an electric circuit, with the magnet body made a cathode and the counter electrodes made anodes. A DC voltage of 10 volts was applied for 10 seconds to effect electrodeposition. The magnet body was pulled out of the slurry and immediately dried in hot air. It was found that a thin coating of terbium hydride had deposited on the magnet body surface. The area density of terbium hydride deposited was 100 μg/mm$^2$ on the magnet body surface.

The magnet body having a thin coating of terbium hydride particles deposited thereon was subjected to absorption treatment in an argon atmosphere at 900° C. for 5 hours. It was then subjected to aging treatment at 500° C. for one hour, and quenched, obtaining a magnet body. The absorption treatment increased the coercive force by 720 kA/m.

Comparative Example 1

As in Example 1, a magnet body having dimensions of 17 mm×17 mm×2 mm (magnetic anisotropy direction) was prepared. Also, terbium oxyfluoride (TbOF) having an average particle size of 0.2 μm was thoroughly mixed with water at a weight fraction of 40%, forming a slurry having terbium oxyfluoride particles dispersed therein.

The magnet body was immersed in the slurry for 7 seconds, pulled out of the slurry and immediately dried in hot air. It was found that a thin coating of terbium oxyfluoride had deposited on the magnet body surface. The area density of terbium oxyfluoride deposited was 20 μg/mm$^2$ on the magnet body surface.

The magnet body having a thin coating of terbium oxyfluoride particles disposed thereon was subjected to absorption treatment in an argon atmosphere at 900° C. for 5 hours. It was then subjected to aging treatment at 500° C. for one hour, and quenched, obtaining a magnet body. The absorption treatment increased the coercive force by 360 kA/m.

Comparative Example 2

As in Example 1, a magnet body having dimensions of 17 mm×17 mm×2 mm (magnetic anisotropy direction) was prepared. Also, terbium hydride ($TbH_3$) having an average particle size of 0.2 μm was thoroughly mixed with ethanol at a weight fraction of 40%, forming a slurry having terbium hydride particles dispersed therein.

The magnet body was immersed in the slurry for 7 seconds, pulled out of the slurry and immediately dried in hot air. It was found that a thin coating of terbium hydride had deposited on the magnet body surface. The area density of terbium hydride deposited was 20 μg/mm$^2$ on the magnet body surface.

The magnet body having a thin coating of terbium hydride particles disposed thereon was subjected to absorption treatment in an argon atmosphere at 900° C. for 5 hours. It was then subjected to aging treatment at 500° C. for one hour, and quenched, obtaining a magnet body. The absorption treatment increased the coercive force by 360 kA/m.

As is evident from Examples 1 to 4 and Comparative Examples 1 and 2, the electrodeposition technique achieves a greater coercive force increase than the conventional immersion technique, both conducted once.

The invention claimed is:

1. A method for preparing a rare earth permanent magnet, comprising the steps of:

immersing a sintered magnet body having a $R^1$—Fe—B base composition wherein $R^1$ is at least one element selected from rare earth elements inclusive of Y and Sc, in an electrodepositing bath of a powder dispersed in water, said powder comprising an oxyfluoride of $R^2$ and/or a hydride of $R^3$ wherein $R^2$ and $R^3$ each are at least one element selected from rare earth elements inclusive of Y and Sc, said electrodepositing bath containing the powder in a weight fraction of 20% to 70%, effecting electrodeposition for letting the powder deposit on the surface of the magnet body in an area density of at least 10 μg/mm$^2$, by applying a DC voltage of 1 to 300 volts between the magnet body and a counter electrode for 1 to 60 seconds, and heat treating the magnet body with the powder deposited on its surface at a temperature equal to or less than a sintering temperature of the magnet body in vacuum or in an inert gas.

2. The method of claim 1 wherein the powder comprising an oxyfluoride of $R^2$ and/or a hydride of $R^3$ has an average particle size of up to 100 μm.

3. The method of claim 1 wherein the powder comprising an oxyfluoride of $R^2$ and/or a hydride of $R^3$ is deposited on the magnet body surface in an area density of at least 60 μg/mm$^2$.

4. The method of claim 1 wherein in the oxyfluoride of $R^2$ and hydride of $R^3$, $R^2$ and $R^3$ each contain at least 10 atom % of Dy and/or Tb.

5. The method of claim 4 wherein in the powder comprising the oxyfluoride of $R^2$ and/or hydride of $R^3$, $R^2$ and $R^3$ each contain at least 10 atom % of Dy and/or Tb, and the total concentration of Nd and Pr in $R^2$ and $R^3$ is lower than the total concentration of Nd and Pr in $R^1$.

6. The method of claim 1, after the heat treatment, further comprising aging treatment at a lower temperature than the heat treatment.

7. The method of claim 1, further comprising cleaning the sintered magnet body with at least one of an alkali, acid and organic solvent, prior to the immersion step.

8. The method of claim 1, further comprising shot blasting the sintered magnet body to remove a surface layer thereof, prior to the immersion step.

9. The method of claim 1, further comprising final treatment after the heat treatment, said final treatment being selected from the group consisting of cleaning with at least one selected from a group consisting of an alkali, acid and organic solvent, grinding, plating and coating.

10. The method of claim 1, wherein the temperature of the heat treatment is in the range of 350° C. to (Ts-10°) C. wherein Ts is the sintering temperature of the magnet body.

11. A method for preparing a rare earth permanent magnet, comprising the steps of:

immersing a sintered magnet body having a $R^1$—Fe—B base composition wherein $R^1$ is at least one element selected from rare earth elements inclusive of Y and Sc, in an electrodepositing bath of a powder dispersed in an organic solvent, said powder comprising a hydride of $R^3$ wherein $R^3$ is at least one element selected from rare earth elements inclusive of Y and Sc, said electrodepositing bath containing the powder in a weight fraction of 20% to 70%, effecting electrodeposition for letting the powder deposit on the surface of the magnet body in an area density of at least 10 μg/mm$^2$, by applying a DC voltage of 1 to 300 volts between the magnet body and a counter electrode for 1 to 60 seconds, and heat treating the magnet body with the powder deposited on its surface at a temperature equal to or less than a sintering temperature of the magnet body in vacuum or in an inert gas.

12. The method of claim 11, wherein the powder has an average particle size of up to 100 μm.

13. The method of claim 11, wherein the powder comprising a hydride of $R^3$ is deposited on the magnet body surface in an area density of at least 60 μg/mm$^2$.

14. The method of claim 11, wherein in the hydride of $R^3$, $R^3$ contains at least 10 atom % of Dy and/or Tb.

15. The method of claim 14, wherein in the powder comprising the hydride of $R^3$, $R^3$ contain at least 10 atom % of Dy and/or Tb, and the total concentration of Nd and Pr in $R^3$ is lower than the total concentration of Nd and Pr in $R^1$.

16. The method of claim 11, after the heat treatment, further comprising aging treatment at a lower temperature than the heat treatment.

17. The method of claim 11, further comprising cleaning the sintered magnet body with at least one of an alkali, acid and organic solvent, prior to the immersion step.

18. The method of claim 11, further comprising shot blasting the sintered magnet body to remove a surface layer thereof, prior to the immersion step.

19. The method of claim 11, further comprising final treatment after the heat treatment, said final treatment being cleaning with at least one selected from the group consisting of an alkali, acid and organic solvent, grinding, plating and coating.

* * * * *